United States Patent [19]

Reisman et al.

[11] Patent Number: 4,870,959

[45] Date of Patent: Oct. 3, 1989

[54] PROTECTIVE BREATHING MASK

[76] Inventors: Ron Reisman, 5 Hasatat St., Jerusalem; Uri Amit, Moshav, Timrat, Migdal Haemek, both of Israel

[21] Appl. No.: 152,888

[22] Filed: Feb. 5, 1988

[51] Int. Cl.[4] ..... A62B 18/04; A62B 7/00; A42B 1/04

[52] U.S. Cl. ..... 128/201.25; 2/7; 2/205; 2/206a

[58] Field of Search ..... 2/205, 202, 206, 7, 2/171; 128/206.12, 206.15, 206.17, 206.19, 201.25, 207.12, 201.28, 205.28

[56] References Cited

U.S. PATENT DOCUMENTS 3,789,839 2/1974 Lund et al. ..... 2/206 X
4,231,118 11/1980 Nakagawa ..... 2/205 X
4,411,023 10/1983 Pinson ..... 2/205 X
4,583,535 4/1986 Saffo ..... 2/205 X

*Primary Examiner*—Peter Nerbun
*Attorney, Agent, or Firm*—Andrew S. Langsam

[57] ABSTRACT

A protective breathing mask comprising fire-resistant stretchable material shaped as a hood for wearing over and enclosing the head. An access opening allows the head to be placed therethrough such that a substantially airtight closure is provided at the neck. In one embodiment, portions of the mask are removed at eye and mouth locations whereat they are replaced by respective viewing and filter materials sealed to the stretchable material. The viewing material comprises transparent fire-resistant material, and the filter material comprises a plurality of fire-resistant flexible layers at least one of which has embedded therein activated charcoal particles.

10 Claims, 2 Drawing Sheets

PROTECTIVE BREATHING MASK

FIELD OF THE INVENTION

The present invention relates to protective gas masks and other protective breathing devices, more particularly, to a fire-resistant protective breathing mask for reducing the respiratory health risks and mortality rates associated with smoke and fume inhalation in fire or gas emergencies.

BACKGROUND OF THE INVENTION

There are known gas masks and protective breathing devices used to insure safe breathing in fire emergencies, for example, the protective breathing devices used by firefighting personnel entering the scene of a fire to rescue fire victims. One of the greatest tragedies associated with the mortality rates in fire emergencies stems from the reality that immediately upon the outbreak of a fire, every second becomes precious in the preservation of life. By the time firefighters arrive at the scene of the fire and locate the victims for rescue procedures, many victims have been overcome with smoke inhalation and may be unconscious and unable to aid the rescue efforts. Untold numbers of fire victims perish not by contact with flames, but through an inability to breathe just long enough to make their way to safety or be located as part of these fire rescue efforts.

The protective breathing apparatus necessary to reduce the tragic consequences of fire and smoke inhalation is not readily available to the average civilian consumer because of prohibitive prices, and a general lack of awareness of the specialized channels of supply for this type of equipment. In addition, the conventional gas mask used by the military for combat and warfare applications is too bulky to be carried by civilians in daily life, and these are not stored by institutions in quantities that would insure instant availability during fire emergencies. A prime example of an institution requiring these devices is a tourist hotel, where many tragic fire fatalities of the past may have been avoided were protective breathing masks instantly available.

In addition to fire emergencies, another major respiratory health hazard today is caused by toxic chemical spillage when freight train cars overturn, with whole residential neighborhoods being placed at risk before evacuation efforts are commenced. Here, the danger posed is primarily that of breathing dangerous fumes, and again, the instant availability of protective breathing apparatus is lacking.

It would therefore be desirable to provide a protective breathing device which is affordable and instantly available for convenient use by civilians in case of fire and gas emergencies and other respiratory health safety risks.

SUMMARY OF THE INVENTION

Accordingly, it is a principal object of the present invention to overcome the above-mentioned difficulties by provision of protective breathing apparatus for fire and health emergencies. It is another object of the invention to provide a convenient, lightweight, affordable, fire-resistant and instantly available gas mask for protection against smoke inhalation and inhalation of other dangerous fumes.

In accordance with a preferred embodiment of the invention, there is provided a protective breathing mask comprising fire-resistant stretchable material shaped as a hood and having an access opening through which the head is placed for wearing the mask over the head and enclosing it such that a substantially airtight closure is provided at the neck, at least a portion of the mask providing a transparent viewing area for the eyes, a mouth location and said stretchable material being replaced by filter materials sealed thereto and comprising a plurality of fire-resistant flexible layers at least one of which has embedded therein activated charcoal particles.

In the preferred embodiment, the protective breathing mask is fabricated from a novel combination of stretchable and fire-resistant materials offering particular advantages in construction while providing viewing and breathing protection features. The novel combination of materials also provides the mask with particularly advantageous features suited to portability, compactness, and instant availability, which are achieved by its lightweight, flexible construction.

The mask itself is a hood-like construction and is made of a neoprene rubber material layer folded back on itself to form front and back panels which are sealed together at seams on three edges. The folded over edge provides the fourth, or bottom edge which is formed with an access opening in the airtight interior volume enclosed by the mask. The hood-like construction may also be achieved by a molding or dipping process, making the mask a seamless enclosure.

The access opening can be pulled apart to enable the user to quickly and easily slip the entire mask over the head. In addition, the access opening is shaped so as to fit snugly around the user's neck, providing a substantially airtight closure without the aid of an additional closing device. The contour of the mask is designed to provide the minimum interior volume needed for wearing over the head. This design minimizes the inrush of surrounding air containing smoke or gas when the access opening in pulled apart for wearing purposes.

The construction of the mask is such that portions of the material in the front panel are removed and are replaced at eye and mouth locations by fire-resistant transparent and filter materials respectively providing viewing and breathing capabilities. The properties of these materials are uniquely suited to the life-saving functions they perform in accordance with the inventive protective breathing mask design. These materials enable the user to maintain his vision and breathing while making his way to safety in a fire or gas emergency.

For the viewing portion of the mask, the transparent material is a high-temperature resistant thermosettic material which does not burn even on contact with a flame. The filter material is provided in portions of the mask to either side of the nose so as to maintain good airflow distribution. Fabricated from a combination of materials provided in several layers, each of the filter materials has a distinct function. For example, three layers of active charcoal cloth are interleaved with two layers of a particle filter. The activate charcoal cloth layers serve to eliminate poisonous gases and acids from the air and the remaining layers provide an air filter to eliminate airborne particles.

In an alternative embodiment, the entire hood is fabricated of a transparent silicone material such that the separate viewing portion is unnecessary.

In still another alternative embodiment, the mask construction is such that the filter portions on either side of the nose are joined by a one-way filter device which facilitates breathing by allowing the user to exhale air therethrough more easily. In this arrangement, inhalation is maintained through the filter layer materials. An important advantage of this one-way device is that by facilitating exhalation, it reduces the amount of condensation on the inside of the mask viewing portion.

A feature of the inventive gas mask is the use of a high-temperature resistant phosphor-like color pattern on the mask outer surface which makes it highly visible even in a smoke-filled area, thereby aiding rescue crews in locating victims. The coloring may be a highly reflective, silver-colored coating which serves the purpose of high visibility and affords heat reflective characteristics.

An alternative to the silver-colored surface coating is the use of large printed lettering on the mask outer surface, providing light reflection characteristics for identifying the locations of victims.

Still another alternative to the coloring pattern or surface coating is the fabrication of the mask from a neoprene material having a bright yellow color.

Another feature of the invention is the overall shape of the mask which is appropriate for most head sizes, without interference from scalp hair. The viewing and filter materials are designed to cover a maximum surface area of the front panel of the mask, making it suitable for many users despite a wide variation in head sizes.

Other features and advantages of the invention will become apparent from the drawings and the description contained hereinbelow.

BRIEF DESCRIPTION OF THE DRAWINGS

For a better understanding of the invention, reference is made to the accompanying drawings in which like numerals designate corresponding elements or sections throughout, and in which.

DETAILED DESCRIPTION OF A PREFERRED EMBODIMENT

Figure 1:
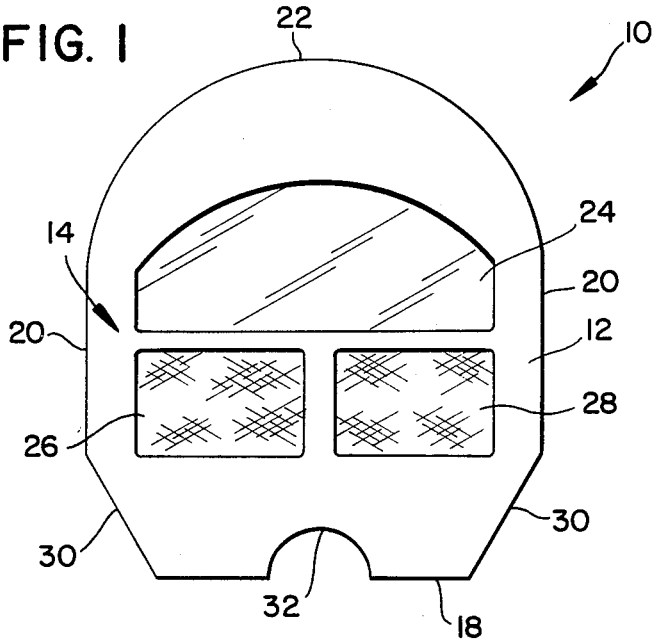
FIG. 1 shows a front view of a protective breathing mask constructed in accordance with the principles of the invention.

Referring now to FIG. 1, there is shown a front view of a protective breathing mask 10 constructed in accordance with the principles of the present invention. The mask 10 comprises a hood-like construction made of a stretchable material 12 such as neoprene rubber or silicone which is fabricated as a thin sheet providing front and rear panels 14 and 16 (rear panel not visible) when folded at a bottom edge 18. Stretchable material 12 typically has 300% or greater stretchability, can withstand temperatures of 250 C, and has an approximate thickness of between 0.2–0.5 mm.

Front and rear panels 14 and 16 form seams which are sealed closed at a pair of side edges 20 and a curved top edge 22. The rear panel 16 is a continuous sheet while portions of material 12 in front panel 14 are cutout to provided a viewing portion 24 and filter portions 26 and 28. In the case where stretchable material 12 is fabricated of silicone, the entire hood is transparent, eliminating separate viewing portion 24.

The lower portions 30 of side edges 20 are slanted inwardly toward the folded bottom edge 18, in which there is cut an access opening 32 in stretchable material 12. Since stretchable material 12 can be pulled apart, access opening 32 provides access to the interior volume of mask 10 between front and rear panels 14 and 16, allowing it to be placed over a user's head.

As further described herein, the protective breathing mask of the present invention is constructed so that respective viewing and filter portions 24, 26 and 28 thereof are fabricated of fire-resistant transparent material and fire-resistant filter materials. These materials are joined to stretchable material 12 in sealing fashion using suitable contact glue or stitching so as to provide an enclosed interior volume of mask 10. When mask 10 is worn in fire or gas emergencies, the material forming viewing portion 24 provides the user with vision capabilities, while the filter portions 26 and 28 filter out noxious gases and enable the user to continue breathing while making his way to safety.

Figure 2:
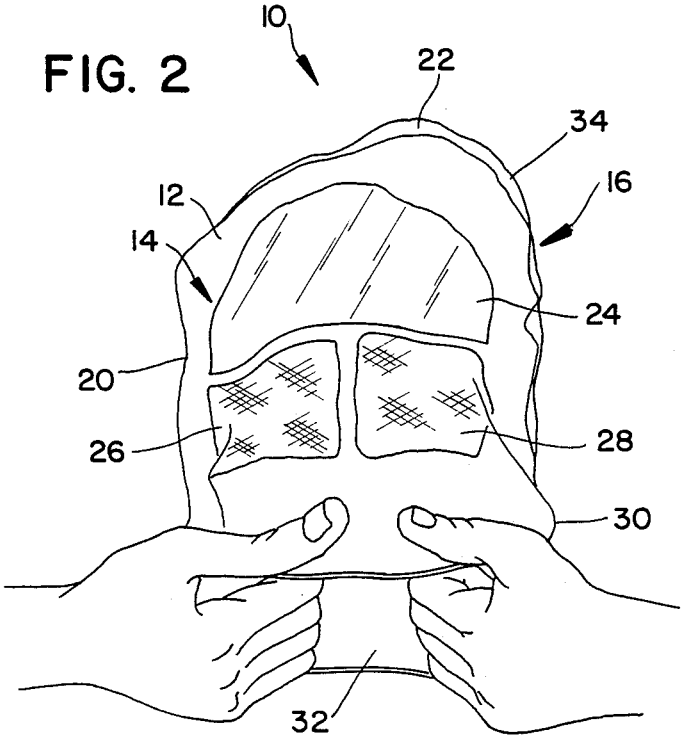
FIG. 2 shows the mask of FIG. 1 being pulled open at an access opening for placement over the user's head.

Referring now to FIG. 2, there is shown a front view of mask 10 of FIG. 1 in which the user has pulled apart stretchable material 12 at access opening 32 in preparation for placement of the mask 10 over his head. By virtue of its design, access opening 32 fits snugly around the user's neck once the mask is in place, thus providing a substantially airtight closure, without the aid of an additional closing device.

It is a particular feature of the inventive protective breathing mask 10 that it is contoured so as to provide a minimum interior volume while being suitable for a wide range of head sizes. This provides an additional safety feature in that when used in a fire or gas emergency, the inrush of surrounding air containing smoke or gas is minimized when stretchable material 12 is pulled apart at access opening 32 for wearing purposes. This contour, defined in part by lower portions 30 of side edges 20, minimizes the user's initial exposure to noxious gases within its interior volume when the mask 10 is first placed over his head.

As shown in FIG. 2, the seam 34 between front and back panels 14 and 16 is formed on three edges, side edges 20 and top edge 22. Seam 34 is sealed by use of suitable contact glue. Since access opening 32 is formed in bottom edge 18 which is folded and does not contain a seam, pulling apart this area of stretchable material 12 does not subject it to stresses which are likely to cause tearing or other deformation. This feature of the design insures the integrity of both the mask shape and its interior volume once it is placed over the user's head.

It is a particular feature of the present invention that the materials used for viewing and filter portions 24, 26 and 28 of mask 10 are materials which provide characteristics uniquely suited to this application, to realize the life-saving functions achieved by the inventive design. Therefore, in the preferred embodiment, these materials are chosen from a group of materials meeting the necessary requirements of being fire-resistant, non-melting and having high temperature withstand capabilities, while being lightweight and flexible.

In accordance with the inventive design, viewing portion 24 is made of a thin, fire-resistant, transparent, thermosettic material which can withstand temperatures of up to 250 C, such as that sold under the tradename Kapton and currently available from DuPont (USA). The thermosettic properties of this material are such that it does not burn even on contact with a flame, instead reducing to a powdered substance which evaporates, but which cannot melt onto the skin or cause breathing difficulties. Fabrication of mask 10 from transparent silicone eliminates the need for a separate viewing portion 24.

Figure 5:
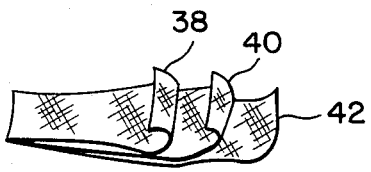
FIG. 5 shows the filter material of FIG. 4 featuring a layered construction of filter elements.

Filter portions 26 and 28 are made of a fire-resistant filter material which is fabricated from a plurality of layers containing a combination of several materials (see FIG. 5). In the preferred embodiment, the filter material is provided in five layers, each having a distinct function. Three of the layers are cloth and have active charcoal embedded in them and these layers are interleaved with an additional two layers of a particle filter material providing an air filter for small particles and smoke. The active charcoal layers serve to eliminate poisonous gases and acids from the air and the remaining layers eliminate airborne particles.

As previously stated, the choice of materials used in construction of mask 10 is based on the combined objectives of providing life-saving functions while exhibiting fire-resistant properties and achieving a lightweight, flexible design. In keeping with these objectives, the materials chosen for the preferred embodiment achieve a mask 10 construction capable of being folded into individual packages of $8 \times 12$ cm weighing 200 grams or less. Such packages would be suitable for carrying in a shirtpocket or personal handbag.

The packaging options for the inventive protective breathing mask 10 are wide and varied, one possible option being the use of small plastic bags into which each mask is folded and which are hermetically sealed to prolong shelf life. These individual packets could then be distributed via retail marketing establishments, making the mask readily accessable to consumers. Another important channel of distribution would be through institutions where fire hazards may exist, notably hotels and other public lodging establishments, where the mask 10 may be provided as standard equipment in guest rooms, instantly available in fire and gas emergencies.

Figure 3:
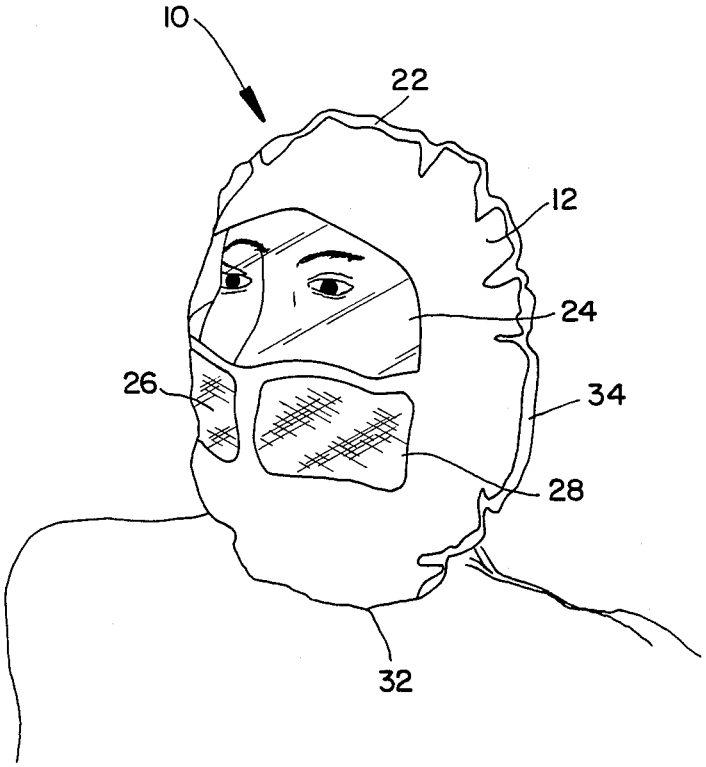
FIG. 3 is a perspective view showing a user wearing the mask over his head.

Referring now to FIG. 3, there is shown a perspective view of a user wearing the inventive mask 10 over his head. As worn, access opening 32 in stretchable material 12 provides a snug fit of mask 10 around the user's neck. Viewing portion 24 covers a semicircular area to give a wide viewing area, while filter portions 26 and 28 are disposed to either side of the nose, to increase air flow distribution in breathing. The viewing and filter portions 24, 26 and 28 provide the user with the ability to maintain viewing and breathing capabilities for a period of approximately 15 minutes or more, depending on the intensity of heat and the density of smoke or gas while a user makes his way to safety.

A feature of the inventive gas mask is the use of a high-temperature resistant phosphor-like coloring pattern on the outer surface of stretchable material 12 which makes it highly visible even in a smoke-filled area, thereby aiding rescue crews in locating victims. The coloring may be a highly reflective, silver-colored coating which serves the purpose of high visibility and affords heat reflective characteristics.

In the case of hotels or other lodging facilities making mask 10 available to its guests, an alternative to the silver-colored surface coating may be the use of large printed lettering, indicating the name of the institution. The lettering is useful since its light reflection characteristics aid in identifying the location of victims. Alternatively, stretchable material 12 may be fabricated of a bright yellow color.

Figure 4:
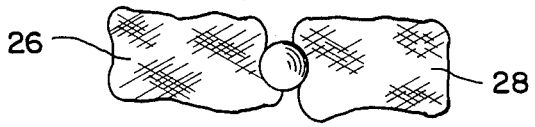
FIG. 4 shows an alternative construction of the filter portion of the mask of FIG. 3 wherein the filter material portions on either side of the nose are joined by a one-way respirator filter device.

Turning now to FIG. 4, an alternative construction of filter portions 26 and 28 is shown. In this design, filter portions 26 and 28 on either side of the nose are joined by a one-way respirator filter device 36. Filter device 36 may be a rubber membrane over a hole to facilitate breathing by allowing the user to exhale air therethrough more easily. In this arrangement, inhalation is maintained through filter portions 26 and 28. An important advantage of filter device 36 is that by facilitating exhalation, it reduces the amount of condensation on the inside of the mask viewing portion 24.

In FIG. 5, the construction of filter portions 26 and 28 is shown. As shown, three layers of combined filter materials are provided in an interleaved sandwich form, each having a distinct function. The combined filter materials comprise five layers, layer 38 being made of two materials, layer 40 made of a single material, and layer 42 made of two materials. Layer 38 comprises a cloth layer in which activated charcoal particles are embedded. The charcoal particles may be treated with silver or copper in concentrations of approximately 1.2% to absorb poisonous gases and acids from the air.

Also formed in layer 38 is a particle filter layer such as a foam which is designed to trap particles above 5 microns in diameter so as to provide an air filter for small particles and smoke. Layer 40 may be a layer of activated charcoal cloth alone. Layer 42 may be another activated charcoal cloth layer formed together with a particle filter such as that manufactured by and available from 3M Corporation (USA) under the tradename Filterette.

The filter material layers 38–42 may be laminated by placing intermediate sheets (not shown) between the different materials in the layers, with the intermediate sheet providing a heat-activated glue. When the layers 38–42 are passed through a hot press, laminated layers are formed. It is preferable to form the intermediate sheets so that the laminated layers result around the edges of the materials only, leaving the central area with spacing between layers 38–42 to aid in absorption of smoke and gases. The combined filter material layers may also be sewn together and to the mask itself.

In alternative embodiments, the number and arrangement of the filter material layers 38–42 may vary, and this will result in variation of the mask filtering capabilities and the duration of the filter material effectiveness in absorbing smoke, gas and particulates.

In summary, it will be seen that the inventive protective breathing mask provides a particulary advantageous combination of life-saving vision and breathing capabilities in a a lightweight, flexible construction suitable for consumer use and instantly available in fire and gas emergencies.

Having described the invention in connection with certain specific embodiments thereof, it is to be understood that the description is not meant as a limitation since further modifications may now suggest themselves to those skilled in the art and it is intended to cover such modifications as fall within the scope of the appended claims.

I claim:

1. A protective breathing mask comprising: fire-resistant stretchable material of not less than about 300% stretchability shaped as a hood and having an access opening through which the head is placed for wearing the mask over the head and enclosing it such that a substantially airtight closure is provided at the neck, said stretchability inherently providing, without ancillary tightening means, a minimum unoccupied interior volume of said hood such that, upon donning, the inrush of surrounding air is minimized, at least a portion of the mask providing a transparent viewing area for the eyes, a mouth location of such stretchable material being replaced by filter materials sealed thereto and comprising a plurality of fire-resistant flexible layers at least one of which has imbedded therein activated charcoal particles.

2. The mask of claim 1 wherein said stretchable material is a thin sheet shaped as a hood having front and rear panels sealed by contact glue at a seam on side and top edges, said access opening being formed in a bottom edge which is folded.

3. The mask of claim 2 wherein said stretchable material is neoprene rubber.

4. The mask of claim 2 wherein said stretchable material is silicone.

5. The mask of claim 5 wherein said transparent viewing area is provided by said silicone stretchable material.

6. The mask of claim 1 wherein said stretchable material is a thin sheet shaped as a hood which is formed as a seamless enclosure.

7. The mask of claim 1 wherein said filter materials comprise five layers of material including three cloth layers each having activated charcoal particles embedded therein, a foam layer, and a particle filter layer.

8. The mask of claim 7 wherein said filter materials are laminated by intermediate glue layers in the region about their edges, leaving space between adjacent filter material layers.

9. The mask of claim 7 wherein said filter material is disposed on either side of the nose.

10. The mask of claim 7 wherein said activated charcoal cloth layers are treated with gas absorbing metallic elements.

* * * * *